US005163823A

United States Patent [19]

Kinoshita et al.

[11] Patent Number: 5,163,823

[45] Date of Patent: Nov. 17, 1992

[54] RECIPROCATING COMPRESSOR HAVING A CYLINDER PROVIDED WITH A GAS PASSAGE

[75] Inventors: Masayoshi Kinoshita; Jun Isono, both of Nagoya, Japan

[73] Assignee: Brother Kogyo Kabushiki Kaisha, Nagoya, Japan

[21] Appl. No.: 810,891

[22] Filed: Dec. 20, 1991

[30] Foreign Application Priority Data

Feb. 15, 1991 [JP] Japan ..... 3-44494

[51] Int. Cl.[5] ..... F04B 21/02

[52] U.S. Cl. ..... 417/571; 92/126; 277/3; 277/27

[58] Field of Search ..... 417/571; 92/86.5, 126, 92/163, 162; 277/3, 27, 175; 123/193.4

[56] References Cited

U.S. PATENT DOCUMENTS 1,260,100 3/1918 Udell ..... 92/86.5

3,514,113 5/1970 Weisworm ..... 277/3

*Primary Examiner*—Richard A. Bertsch

*Assistant Examiner*—Charles G. Freay

*Attorney, Agent, or Firm*—Oliff & Berridge

[57] ABSTRACT

A compressor includes a passage in the sidewall of the cylinder for directing compressed gas against circumferential surfaces of piston rings. The pressure of the gas from the passage counteracts the pressure of gas between the piston ring groove and the piston ring, and urges the piston rings inwardly. The force with which the piston ring is urged into engagement with the cylinder walls is lessened, thereby reducing wear of the piston rings. The arrangement is especially useful for compressors having piston rings formed of low friction polymeric materials, such as fluorine-containing polymers.

25 Claims, 3 Drawing Sheets

RECIPROCATING COMPRESSOR HAVING A CYLINDER PROVIDED WITH A GAS PASSAGE

BACKGROUND OF THE INVENTION

1. Field of the invention

The present invention relates to a reciprocating compressor for compressing gas such as air, and more particularly to a reciprocating compressor having a cylinder provided with a gas passage for passing compressed gas therethrough.

2. Description of the Related Art

FIG. 5 shows a conventional reciprocating compressor. Referring to FIG. 5, a piston 33 having a plurality of piston rings 36 on an outer circumferential surface thereof is adapted to be vertically reciprocated in a cylinder 31. When the piston 33 is lowered, gas is sucked from a suction valve 37 into the cylinder 31. Thereafter, when the piston 33 is lifted to come near a top dead center, the compressed gas in the cylinder 31 is discharged from a discharge valve 38 to the outside.

To reduce sliding friction between outer circumferential surfaces 47 of the piston rings 36 and an inner circumferential surface 41 of the cylinder 31 during vertical reciprocation of the piston 33 without using lubricating oil (i.e., in case of what is called an oil free type), the piston rings 36 are made of synthetic resin having a heat resistance and a low coefficient of friction, such as polytetrafluoroethylene (tetrafluoride resin) polychlorotrifluoroethylene (trifluoride resin).

The above-mentioned synthetic polymeric fluoride resins have a low coefficient of friction, but also have a low wear resistance. In particular, the amount of wear of the piston rings 36 greatly increases with an increase in sliding surface pressure of the outer circumferential surfaces 47 of the piston rings 36 against the inner circumferential surface 41 of the cylinder 31.

The piston rings 36 are engaged with ring grooves 35 formed on an outer circumferential surface 43 of the piston 33, and they are elastically projected from ring grooves 35 outwardly in a radial direction of the piston 33. During a gas compression stroke of the piston 33, the compressed gas of high pressure in the cylinder 31 penetrates from an upper surface of the piston 33 through a gap between the outer circumferential surface 43 of the piston 33 and the inner circumferential surface 41 of the cylinder 31 into the ring grooves 35. The compressed gas having entered the ring grooves 35 acts as a back pressure depicted by arrows 45 against inner circumferential surfaces 48 of the piston rings 36 so as to radially outwardly urge the piston rings 36. The back pressure against the inner circumferential surfaces 48 of the piston rings 36 is increased near the top dead center to further increase the sliding surface pressure of the outer circumferential surfaces 47 of the piston rings 36 against the inner circumferential surface 41 of the cylinder 31. Accordingly, the wear of the piston rings 36 made of the above-mentioned synthetic resin becomes remarkable. As a result, the durability of the piston rings 36 is reduced, and the synthetic resin powdered by the wear is mixed with the compressed gas in the cylinder 31 to contaminate the compressed gas.

SUMMARY OF THE INVENTION

It is an object of the present invention to prevent wear of a piston ring due to the sliding friction between the inner circumferential surface of the cylinder and the outer circumferential surface of the piston ring during vertical reciprocation of the piston.

It is another object of the present invention to reduce the sliding surface pressure of the outer circumferential surface of the piston ring against the inner circumferential surface of the cylinder by applying the compressed gas from the inner circumferential surface of the cylinder to the outer circumferential surface of the piston ring when the piston is lifted up to near the top dead center at which a back pressure to the piston ring becomes maximum.

To achieve the above objects, the reciprocating compressor of the present invention comprises a cylinder having an inner circumferential surface and adapted to suck gas thereinto; a piston having an outer circumferential surface and adapted to vertically reciprocate along the inner circumferential surface of the cylinder; an annular groove formed on the outer circumferential surface of the piston; an annular piston ring engaged with the annular groove and having an outer circumferential surface contacting the inner circumferential surface of the cylinder so as not to allow the escape of gas compressed during a lifting stroke of the piston through a gap between the outer circumferential surface of the piston and the inner circumferential surface of the cylinder; and a gas passage provided in a wall portion of the cylinder for introducing the compressed gas in the cylinder to the outer circumferential surface of the piston ring so as to radially inwardly urge the outer circumferential surface of the piston ring.

With this construction, when the piston is lifted to compress the gas in the cylinder, the compressed gas is introduced through the gas passage formed in the wall portion of the cylinder to the outer circumferential surface of the piston ring so as to radially inwardly urge the outer circumferential surface of the piston ring, thereby canceling the back pressure radially outwardly urging the piston ring.

Accordingly, the sliding surface pressure of the outer circumferential surface of the piston ring against the inner circumferential surface of the cylinder can be reduced to thereby reduce the wear of the piston ring and accordingly prolong the service life. Consequently, a reciprocating compressor having a superior durability can be provided.

BRIEF DESCRIPTION OF THE DRAWINGS

A preferred embodiment of the present invention will be described in detail with reference to the following figures wherein.

DETAILED DESCRIPTION OF THE PREFERRED EMBODIMENTS

Figure 1:
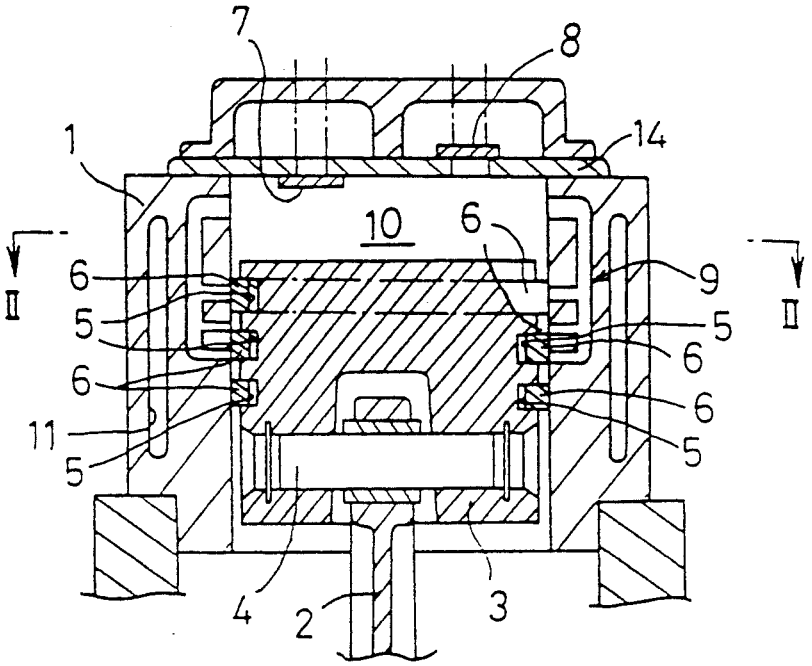
FIG. 1 is a sectional side view of a reciprocating compressor according to a first preferred embodiment of the present invention.

There will now be described some preferred embodiments of the present invention. Referring to FIG. 1 which is a sectional side view of a reciprocating compressor according to a first preferred embodiment of the present invention, reference numeral 1 denotes a cylinder made of metal such as aluminum alloy. In the cylinder 1, a piston 3 is adapted to be vertically reciprocated through a piston pin 4 rotatably engaged with an upper end of a connecting rod 2. A plurality of ring grooves 5 are annularly formed on an outer circumferential surface of the piston 3 at suitable positions below an upper end of the piston 3. With each ring groove 5 is engaged a piston ring 6 made of a material having a small coefficient of sliding friction, such as polymeric resins of polytetrafluoroethylene or polychlorotrifluoroethylene. The connecting rod 2 is connected with a crank shaft (not shown) adapted to be rotated by a prime mover (not shown), so that the vertical reciprocation of the piston 3 in the cylinder 1 as mentioned above is caused by vertical movement of the connecting rod 2. In a lowering stroke of the piston 3, a suction valve 7 provided on a cylinder head 14 is opened to suck the gas to be compressed, such as air, into a cylinder chamber 10. In a lifting stroke of the piston 3, the gas in the cylinder chamber 10 is compressed, and a discharge valve 8 provided on the cylinder head 14 is opened in the vicinity of a top dead center to discharge the compressed gas of high pressure to be introduced to an outside necessary place.

Figure 2:
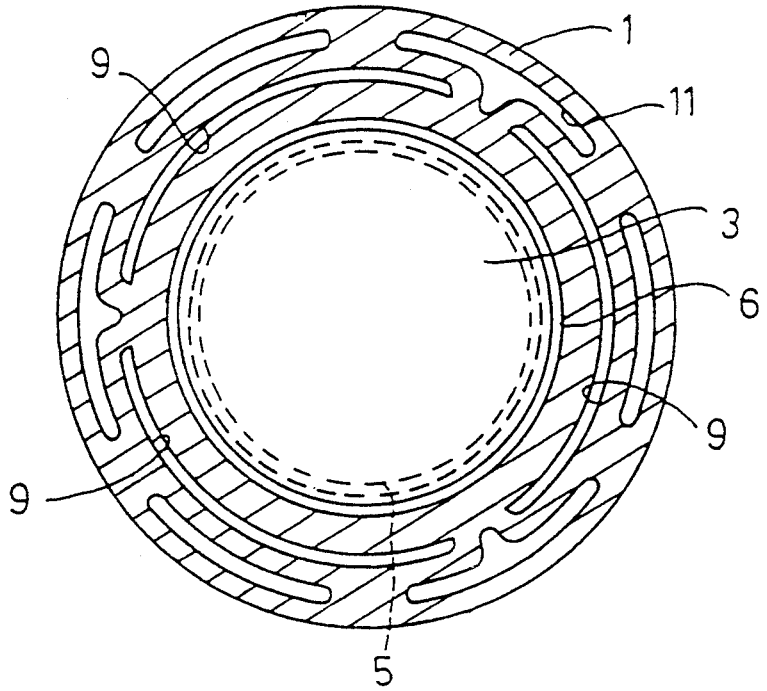
FIG. 2 is a cross section taken along the line II—II in FIG. 1.
Figure 3:
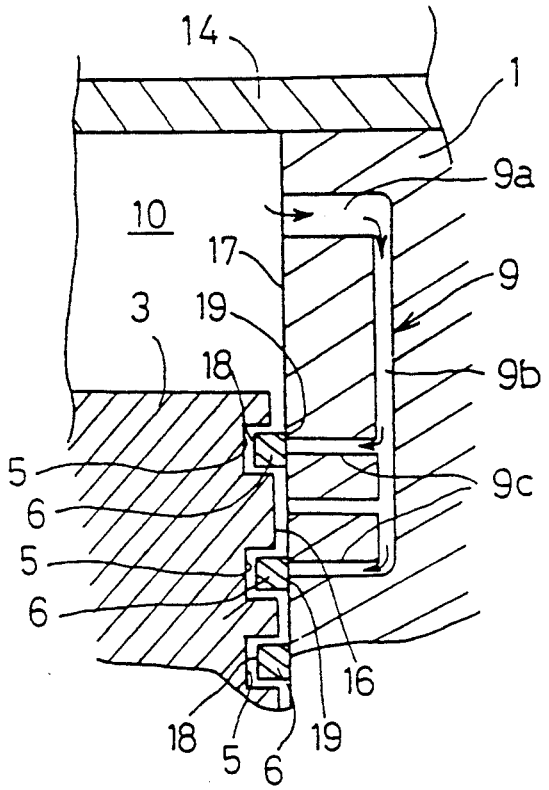
FIG. 3 is a vertical sectional view of an essential part illustrating a gas passage according to the first preferred embodiment.

As shown in FIGS. 1 to 3, an orifice 9 is provided in an inner circumferential wall portion (thick wall portion) of the cylinder 1. The orifice 9 is comprised of an upper inlet 9*a* for admitting the compressed gas from the cylinder chamber 10, a vertical passage 9*b* continuing from the upper inlet 9*a*, and a plurality of lower outlets 9*c* continuing from the vertical passage 9*b* for discharging the compressed gas to outer circumferential surfaces 19 of the piston rings 6. When the piston 3 is lifted up to near the top dead center, the high-pressure gas compressed by the piston 3 in the cylinder chamber 10 is introduced from the upper inlet 9*a* of the orifice 9. The compressed gas introduced from the upper inlet 9*a* passes through the vertical passage 9*b* extending vertically in the inner circumferential wall portion of the cylinder 1 to reach the lower outlets 9*c*. Then, the compressed gas is discharged from the lower outlets 9*c* in such a manner as to radially inwardly urge the outer circumferential surfaces 19 of the piston rings 6 (see arrows in FIG. 3). Incidentally, the inner circumferential wall portion of the cylinder is provided with a cooling passage for passing a cooling water or a cooling air therethrough.

In operation, when the piston 3 is lifted to come near the top dead center, the gas pressure in the cylinder chamber 10 is rapidly increased. The high-pressure gas in the cylinder chamber 10 passes through a gap between an outer circumferential surface 16 of the piston 3 and an inner circumferential surface 17 of the cylinder 1 to enter the ring grooves 5 and radially outwardly urge inner circumferential surfaces 18 of the piston rings 6. As a result, a back pressure to the piston rings 6 is increased to accordingly increase a sliding surface pressure of the outer circumferential surfaces 19 of the piston rings 6 against the inner circumferential surface 17 of the cylinder 1. However, as mentioned above, the high-pressure gas compressed by the piston 3 also passes through the orifice 9 formed in the inner circumferential wall portion of the cylinder to reach the outer circumferential surfaces 19 of the piston rings 6 and radially inwardly urge the outer circumferential surfaces 19 of the piston rings 6.

In this manner, the compressed gas in the cylinder chamber 10 partly passes through the orifice 9 and acts in such a direction as to cancel the back pressure to the piston rings 6. Accordingly, the sliding surface pressure of the outer circumferential surfaces 19 of the piston rings 6 against the inner circumferential surfaces 17 of the cylinder 1 can be reduced to that extent.

Figure 4:
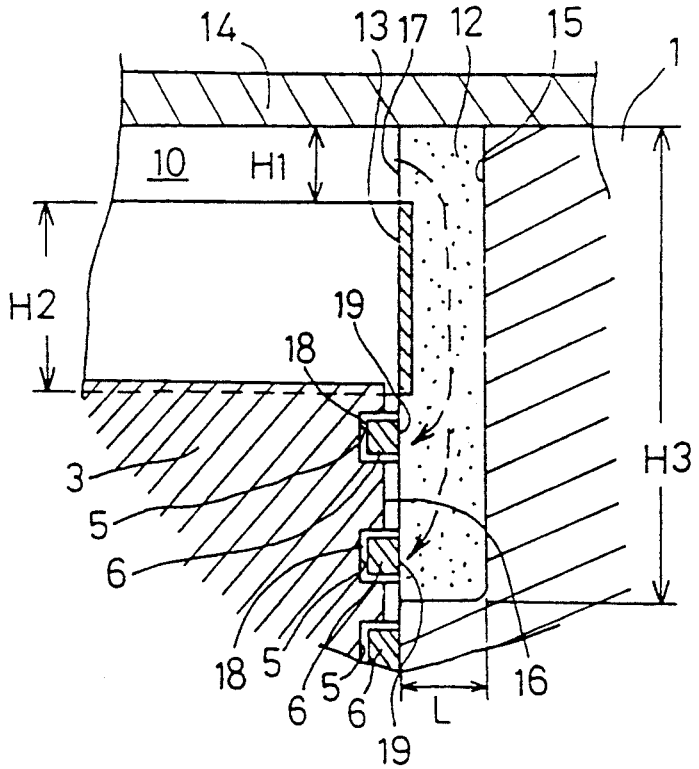
FIG. 4 is a view similar to FIG. 3, illustrating a second preferred embodiment of the present invention.
Figure 5:
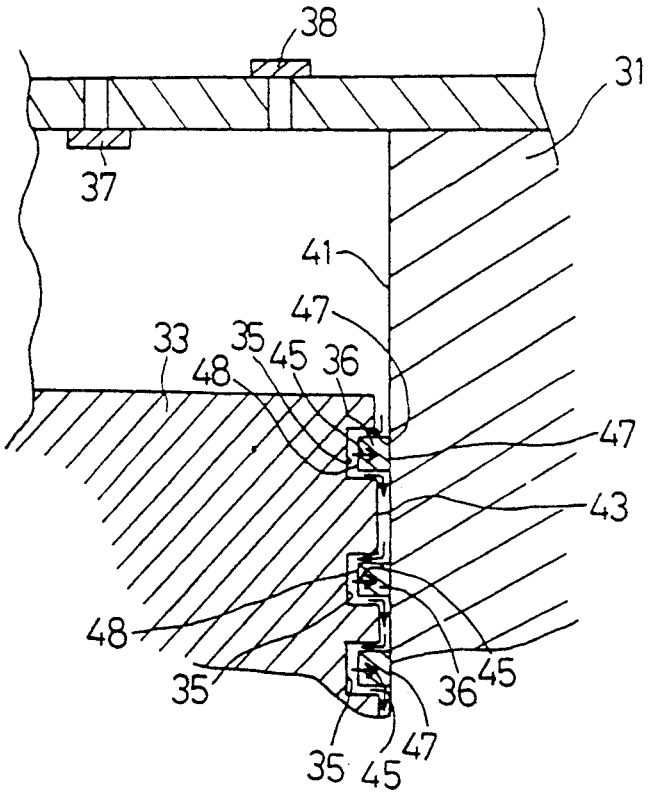
Fig.5 PRIOR ART
FIG. 5 is a vertical sectional view of an essential part of the reciprocating compressor in the prior art.

FIG. 4 shows a second preferred embodiment of the present invention. As shown in FIG. 4, a porous member 12 is embedded in the inner circumferential wall portion of the cylinder 1 over a distance from near the top dead center of the piston 3 in association with its vertical reciprocation to a lower position by a distance approximately equal to the height H3 of the piston 3. That is, the porous member 12 is embedded over such a distance that when the piston 3 is lifted up to near the top dead center, the compressed gas is prevented from flowing through the porous member 12 to a lower side of the piston 3.

The porous member 12 is made of a porous ceramic material having a superior pressure resistivity, constituted of alumina, silicon carbide, silicon nitride, $SnO_2$, or $SiO_2$.

Further, as shown in FIG. 4, it is preferable that an unnecessary pore portion of the porous member 12 is sealed by a suitable sealing member 13, so as to effectively concentrate the high-pressure gas in the cylinder chamber 10 toward an inner circumferential surface of the porous member 12 facing the outer circumferential surfaces 19 of the piston rings 6 (see dashed arrows in FIG. 4). The sealing member 13 is provided along the inner circumferential surface 17 of the cylinder 1 over the entire circumference thereof or at circumferential intervals with a suitable height (H2) to extend below a lower surface of the cylinder head 14 by a distance at least equal to the height (H1). The sealing member 13 is made of thermosetting synthetic resin, metal, ceramic, or cermet (which is a sintered material of a mixture of metal powder and ceramic). The sealing member 13 is formed on an inner circumferential surface of the porous member 12 by a suitable method such as melt impregnation, thermal spraying, or plating, according to the material employed for the sealing member 13.

In embedding the porous member 12, it is preferable that a recess 15 is first formed by cutting the inner circumferential surface of the cylinder at an upper portion thereof to a suitable depth (L) and a suitable height (H3), and then the porous member 12 having numerous pores therein communicating with the outer circumferential surfaces 19 of the piston rings 6 is embedded in the recess 15. According to this method, the porous member 12 can be very easily provided in the inner circumferential wall portion of the cylinder 1 so as to be exposed to the inner circumferential surface 17 of the cylinder 1, so that manufacturing costs can be greatly reduced.

What is claimed is:

1. A reciprocating compressor comprising:

a cylinder having an inner circumferential surface and inlet means for allowing a gas to be drawn into the cylinder;

a piston having an outer circumferential surface and means for mounting the piston to reciprocate along the inner circumferential surface of said cylinder;

an annular groove formed on the outer circumferential surface of said piston;

an annular piston ring engaged with said annular groove and having an outer circumferential surface contacting the inner circumferential surface of said cylinder, said piston ring sealing a gap between the outer circumferential surface of said piston and the inner circumferential surface of said cylinder; and a gas passage provided in a wall portion of said cylinder for introducing compressed gas from said cylinder to the outer circumferential surface of said piston ring, whereby the outer circumferential surface of said piston ring is urged radially inwardly.

2. The reciprocating compressor as in claim 1, wherein said gas passage comprises an inlet portion for admitting the compressed gas from said cylinder, a passage portion for carrying the compressed gas admitted from said inlet portion, and an outlet portion for discharging the compressed gas carried through said passage portion to the outer circumferential surface of said piston ring.

3. The reciprocating compressor as in claim 1, wherein said gas passage comprises a porous member.

4. The reciprocating compressor as in claim 3, wherein said porous member extends a distance from the top dead center position of said piston reciprocation to a position spaced from said top dead center position by a distance greater than the length of said piston, so that compressed gas does not flow from the porous member to a lower side of said piston.

5. A reciprocating compressor comprising:

a cylinder having an inner circumferential surface and an inlet means for allowing gas to be drawn into the cylinder;

a piston having an outer circumferential surface and mean for mounting the piston to reciprocate along the inner circumferential surface of said cylinder;

an annular groove formed on the outer circumferential surface of said piston;

an annular piston ring engaged with said annular groove and having an outer circumferential surface contacting the inner circumferential surface of said cylinder, said piston ring sealing a gap between the outer circumferential surface of said piston and the inner circumferential surface of said cylinder; and a gas passage provided in a wall portion of said cylinder for receiving compressed gas from said cylinder, carrying the compressed gas, and discharging the compressed gas against the outer circumferential surface of said piston ring to urge the piston ring inwardly.

6. The reciprocating compressor as in claim 5, wherein said piston ring is made of a non-metallic material having a low coefficient of sliding friction, thereby reducing wear between the outer circumferential surface of said piston ring and the inner circumferential surface of said cylinder.

7. The reciprocating compressor as in claim 6, wherein said non-metallic material is a polymeric resin.

8. The reciprocating compressor as in claim 7, wherein said polymeric resin contains fluorine.

9. A reciprocating compressor comprising:

a cylinder having an inner circumferential surface and means for allowing gas to be drawn into the cylinder;

a piston having an outer circumferential surface and means for mounting the piston to reciprocate along the inner circumferential surface of said cylinder;

an annular groove formed on the outer circumferential surface of said piston;

an annular piston ring engaged with said annular groove and having an outer circumferential surface contacting the inner circumferential surface of said cylinder, said piston ring sealing a gap between the outer circumferential surface of said piston and the inner circumferential surface of said cylinder; and a porous member provided in a wall portion of said cylinder for introducing compressed gas from said cylinder to the outer circumferential surface of said piston ring to urge the outer circumferential surface of said piston ring inwardly.

10. The reciprocating compressor as in claim 9, wherein said porous member extends over a distance from near the top dead center position of said piston reciprocation to a second position spaced from said top dead center position, which distance is less than the length of said piston, so flow of the compressed gas to a lower side of said piston is prevented.

11. The reciprocating compressor as in claim 9, wherein said porous member is formed of a porous ceramic material selected from the group consisting of alumina, silicon carbide, silicon nitride, $SnO_2$ or $SiO_2$.

12. The reciprocating compressor as in claim 9, further comprising a sealing member provided in said porous member for inhibiting flow of the compressed gas in said porous member, to portions of the cylinder, thereby concentrating the compressed gas at the location of the outer circumferential surface of said piston ring.

13. The reciprocating compressor as in claim 12, wherein said sealing member is formed of a material selected from the group consisting of thermosetting synthetic resin, metal, ceramic, or cermet.

14. The reciprocating compressor as in claim 13, wherein said sealing member is formed on said porous member by melt impregnation.

15. The reciprocating compressor as in claim 13, wherein the sealing member is formed on the porous member by thermal spraying.

16. The reciprocating compressor as in claim 13, wherein the sealing member is formed on the porous member by plating.

17. The reciprocating compressor as in claim 9, wherein the inner circumferential surface of said cylinder at an upper portion thereof has a recess, and said porous member is received in said recess.

18. The reciprocating compressor as in claim 17, wherein the recess is cylindrical and wherein said porous member is shaped as a cylindrical sleeve.

19. A compressor comprising:

a cylinder having an inner circumferential surface;

a piston reciprocable in the cylinder;

a piston ring on the piston having an outer circumferential surface in engagement with the inner surface of the cylinder; and means for directing gas compressed by the piston toward the outer circumferential surface of the piston ring to urge the piston ring inwardly.

20. A compressor as in claim 19, wherein the means for directing gas comprises a passage extending from a first portion of the cylinder to a second portion of the cylinder.

21. A compressor as in claim 20, wherein the outer circumferential surface of the piston ring is formed of a non-metallic material.

22. A compressor as in claim 21, wherein the non-metallic material is a fluoropolymer.

23. A compressor as in claim 19, wherein the means for directing gas comprises a porous member extending from one portion of the cylinder to a second portion of the cylinder.

24. A compressor as in claim 22, wherein the outer circumferential surface of the piston ring is formed of a non-metallic material.

25. A compressor as in claim 24, wherein the non-metallic material is a fluoropolymer.

* * * * *